US007124965B1

(12) United States Patent
Chen

(10) Patent No.: US 7,124,965 B1
(45) Date of Patent: Oct. 24, 2006

(54) SPRAYING GUN

(75) Inventor: Chin-Yuan Chen, Lu Kang Chen (TW)

(73) Assignee: Shin Tai Spurt Water of the Garden Tools Co., Ltd., Lu Kang Chen (TW)

( * ) Notice: Subject to any disclaimer, the term of this patent is extended or adjusted under 35 U.S.C. 154(b) by 206 days.

(21) Appl. No.: 10/951,095

(22) Filed: Sep. 27, 2004

(51) Int. Cl.
*B05B 7/02* (2006.01)

(52) U.S. Cl. ..... 239/525; 239/524; 239/526; 239/581.2; 239/582.1; 239/452; 239/416.4; 239/441

(58) Field of Classification Search ..... 239/525, 239/526, 527, 528, 529, 533.1, 581.2, 582.1, 239/569–571, 456–460, 461–524, 393, 378, 239/452, 441, 416.4
See application file for complete search history.

(56) References Cited

U.S. PATENT DOCUMENTS 2,936,960 A * 5/1960 Thompson ..... 239/458
4,172,559 A * 10/1979 Allenbaugh, Jr. ..... 239/453
4,470,549 A * 9/1984 McMillan et al. ..... 239/583
4,653,693 A * 3/1987 Steingass ..... 239/460
4,944,460 A * 7/1990 Steingass ..... 239/428.5
5,312,048 A * 5/1994 Steingass et al. ..... 239/441
6,007,001 A * 12/1999 Hilton ..... 239/452
6,598,810 B1 * 7/2003 Lanteri ..... 239/452
D515,662 S * 2/2006 Chen ..... D23/223
2005/0178858 A1 * 8/2005 Roman ..... 239/526
2005/0274825 A1 * 12/2005 Seguin ..... 239/525

* cited by examiner

*Primary Examiner*—David A. Scherbel
*Assistant Examiner*—Trevor McGraw
(74) *Attorney, Agent, or Firm*—Alan D. Kamrath; Nikolai & Mersereau, P.A.

(57) ABSTRACT

A spraying gun includes a gun body, a handle, a sealing gasket, a connecting member, a control valve, a control handle, an outer control tube, a control shaft, a catch block, an inner control tube, a control ring, a drive ring, and a nozzle assembly. The nozzle assembly includes a nozzle head, a first mounting ring, a second mounting ring, and a rotation ring. Thus, the spraying gun has a three-stage control effect to provide different water output functions so as to fit a user's practical requirements, thereby enhancing the versatility of the spraying gun.

18 Claims, 9 Drawing Sheets

SPRAYING GUN

BACKGROUND OF THE INVENTION

1. Field of the Invention

The present invention relates to a spraying gun, and more particularly to a spraying gun having multiple water output functions.

2. Description of the Related Art

A conventional spraying gun comprises a gun body having an inside formed with a water channel having a first end connected to a water inlet pipe and a second end connected to a nozzle having a plurality of water outlet holes. The water from the water inlet pipe is introduced into the water channel and is injected outward from the water outlet holes of the nozzle. However, the water from the water inlet pipe is injected outward from the water outlet holes of the nozzle constantly, so that the sprinkling manner of the conventional spraying gun is fixed and cannot be adjusted, thereby limiting the versatility of the conventional spraying gun.

Another conventional spraying gun comprises a gun body having an inside formed with a water channel having a first end connected to a water inlet pipe and a second end connected to a nozzle, a water control unit mounted in the water channel to open or close the water channel and having a distal end protruding outward from the gun body, and a press lever pivotally mounted on the gun body and connected to the distal end of the water control unit. When the press lever is pressed toward the gun body, the water control unit is moved by pivot of the press lever to open the water channel, so that water contained in the water channel is injected outward from the nozzle. However, the water flow rate injected outward from the nozzle cannot be controlled and regulated to satisfy the user's requirement, so that the water output easily exceeds the practical requirement, thereby greatly causing a water consumption.

SUMMARY OF THE INVENTION

The primary objective of the present invention is to provide a spraying gun having multiple water spraying and sprinkling functions.

Another objective of the present invention is to provide a spraying gun that has a three-stage control effect to provide different water output functions so as to fit a user's practical requirements, thereby enhancing the versatility of the spraying gun.

A further objective of the present invention is to provide a spraying gun, wherein the control handle is pivoted on the gun body to rotate the control valve so as to open and close the water flow and to adjust the water flow rate of the spraying gun.

A further objective of the present invention is to provide a spraying gun, wherein the control ring is rotated to drive the push member to push the inner control tube to move to change the gap defined between the catch block and the end portion of the inner control tube, so as to adjust the diffusion angles and the strength of the water flow ejected outward from the gap.

A further objective of the present invention is to provide a spraying gun, wherein the drive ring is rotated to move the nozzle assembly to change the distance between the blades of the rotation ring and the gap defined between the catch block and the end portion of the inner control tube, so as to adjust the diffusion areas and the intensity of the water flow ejected outward from the gap.

Further benefits and advantages of the present invention will become apparent after a careful reading of the detailed description with appropriate reference to the accompanying drawings.

DETAILED DESCRIPTION OF THE INVENTION

Figure 1:
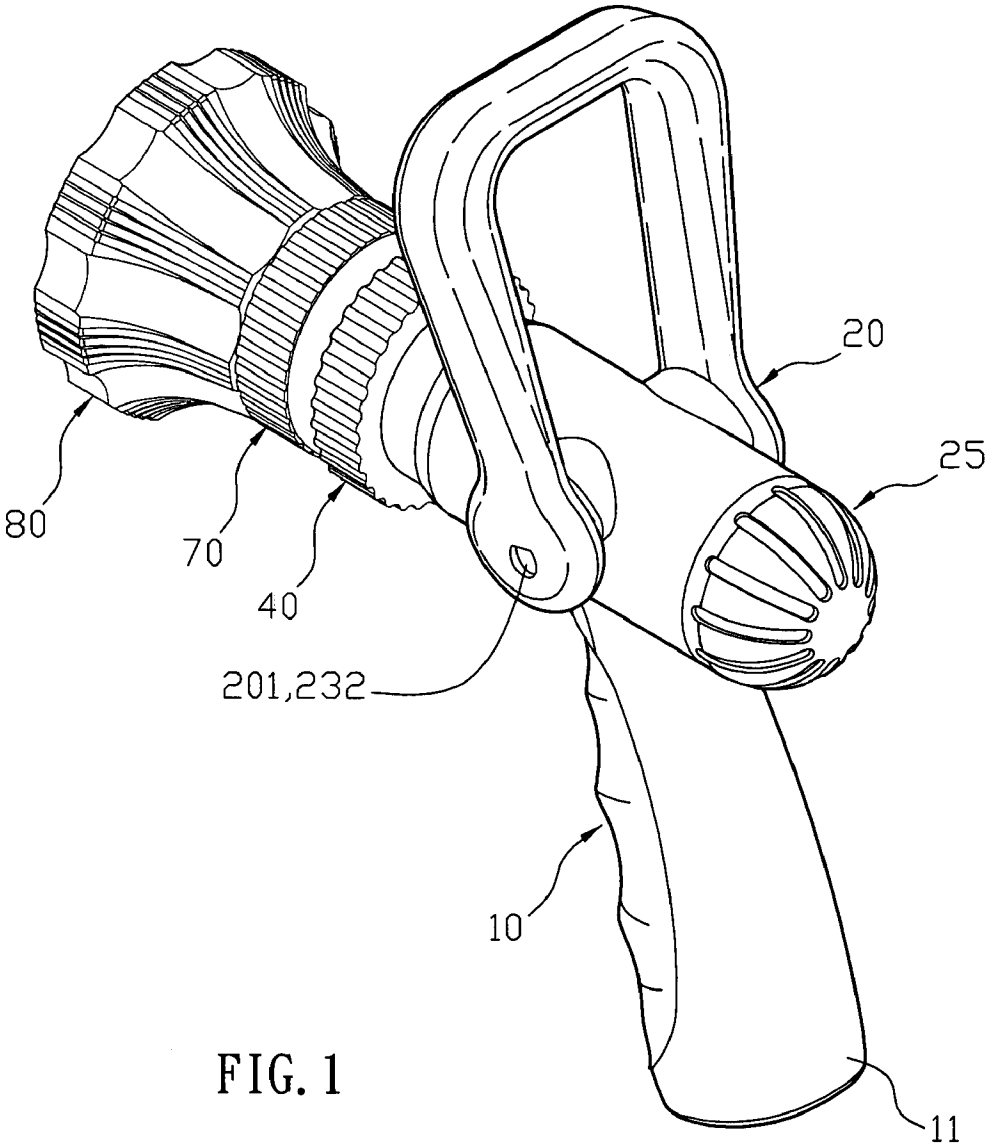
FIG. 1 is a perspective view of a spraying gun in accordance with the preferred embodiment of the present invention.
Figure 2:
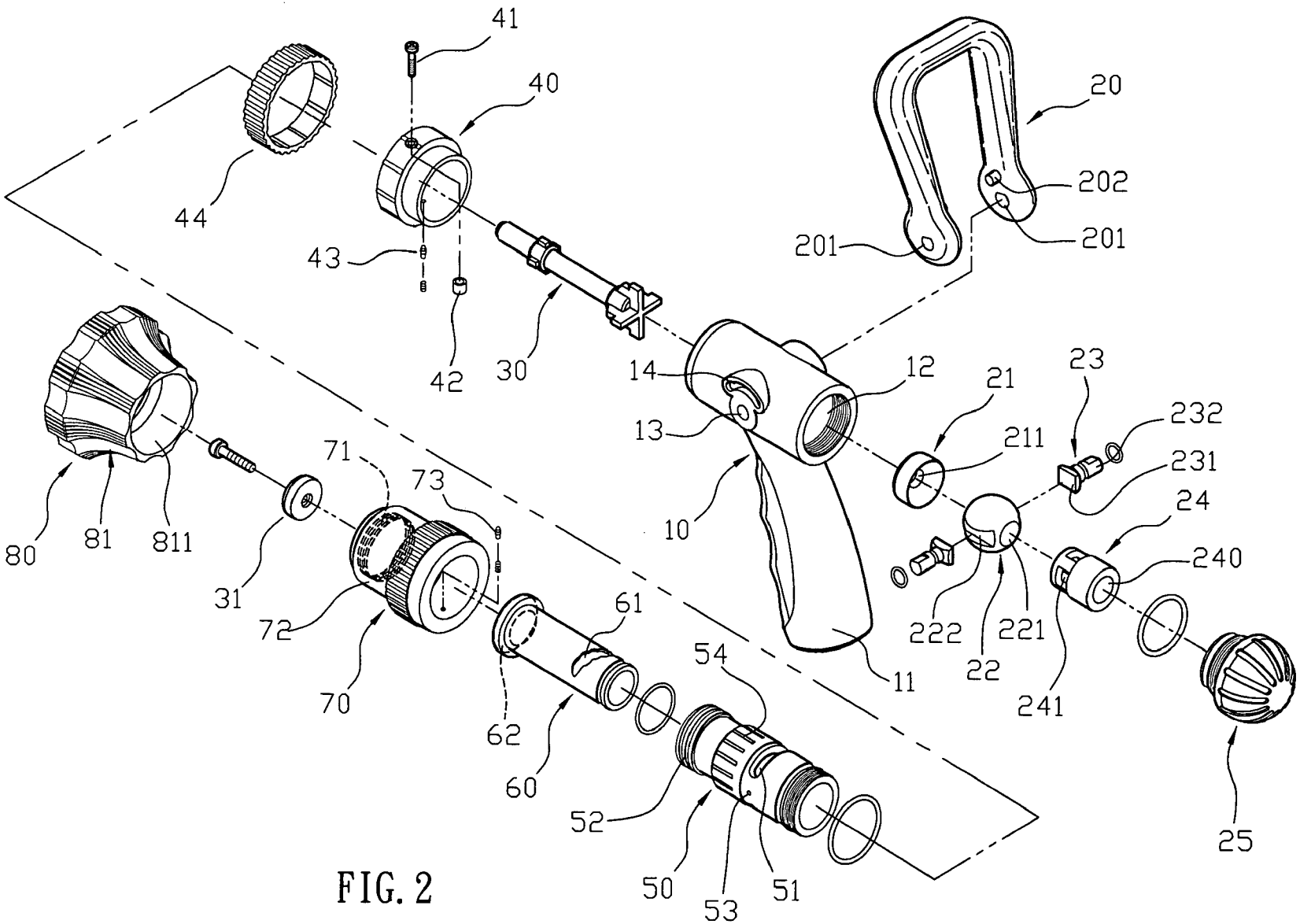
FIG. 2 is an exploded perspective view of the spraying gun as shown in FIG. 1.
Figure 3:
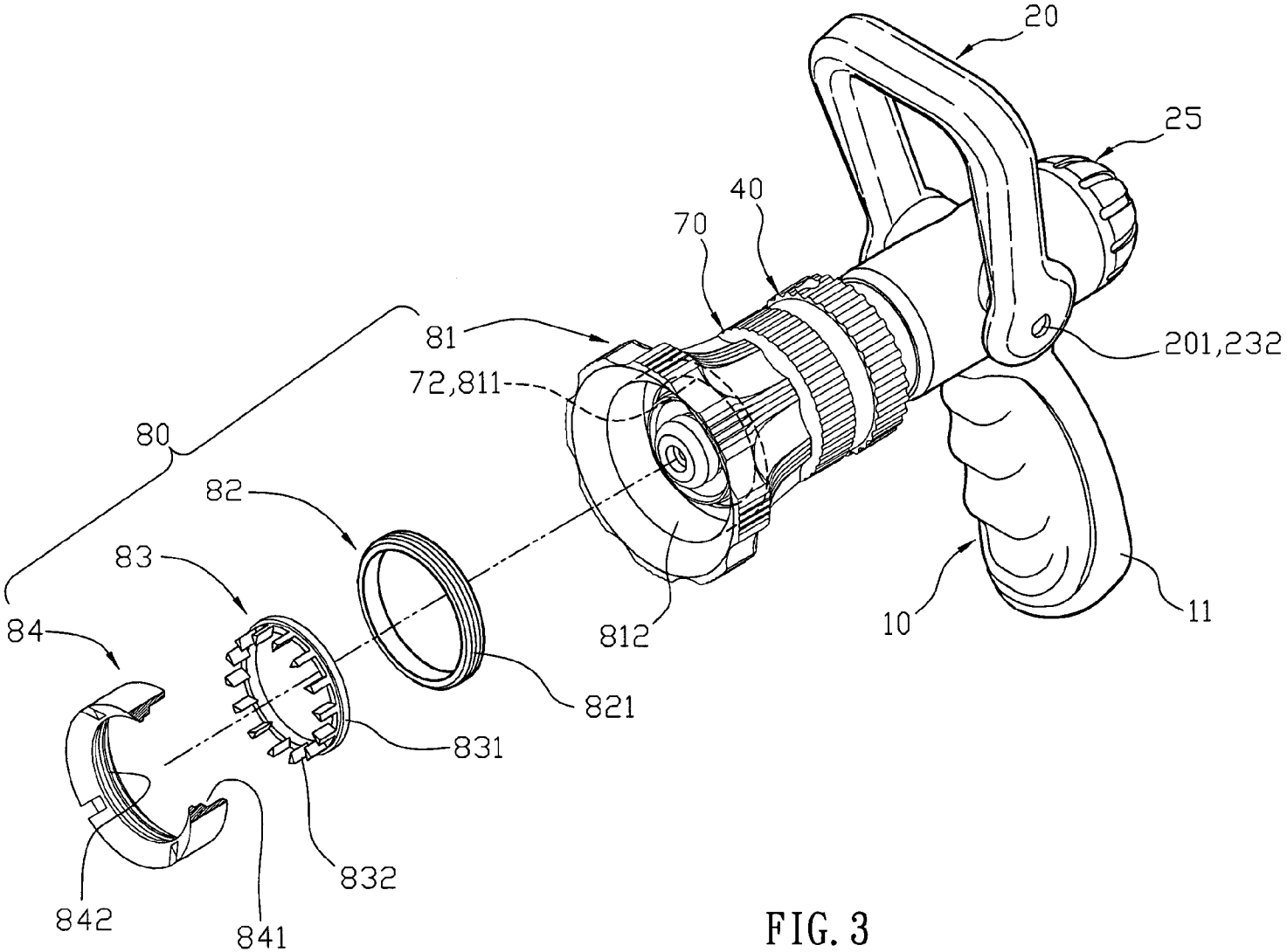
FIG. 3 is a partially exploded perspective view of the spraying gun as shown in FIG. 1.

Referring to the drawings and initially to FIGS. 1–6, a spraying gun in accordance with the preferred embodiment of the present invention comprises a gun body 10 having an inside formed with a chamber 12, a handle 11 mounted on the gun body 10 and having an inside formed with a water inlet channel 110 connected to the chamber 12 of the gun body 10, a sealing gasket 21 mounted in a rear portion of the chamber 12 of the gun body 10 and having an inside formed with a through hole 211, a cylindrical connecting member 24 mounted in the chamber 12 of the gun body 10 and having an inside formed with a passage 240 and a peripheral wall formed with a plurality of conducting holes 241 each connected to the passage 240 and the water inlet channel 110 of the handle 11, and a spherical control valve 22 rotatably mounted in the chamber 12 of the gun body 10 between the sealing gasket 21 and the connecting member 24 and having an inside formed with a control hole 221 connected to the passage 240 of the connecting member 24 and the through hole 211 of the sealing gasket 21.

The control valve 22 is rotatable in the chamber 12 of the gun body 10 to move the control hole 221 so that the passage 240 of the connecting member 24 is partially connected to the control hole 221 of the control valve 22 and partially interrupted by a peripheral wall of the control valve 22, thereby changing a contact area between the peripheral wall of the control valve 22 and the passage 240 of the connecting member 24 so as to adjust a flow rate from the passage 240 of the connecting member 24 into the control hole 221 of the control valve 22.

A substantially U-shaped control handle 20 is pivotally mounted on the gun body 10 and connected to the control valve 22 to rotate the control valve 22. An end cap 25 is mounted on the gun body 10 and rested on the connecting member 24 to cover the connecting member 24 in the chamber 12 of the gun body 10.

The gun body 10 has two opposite sides each formed with a pivot hole 13 and an arc-shaped guide slot 14, the control handle 20 has two distal ends each formed with a fixing hole 201 aligning with the respective pivot hole 13 of the gun body 10 and a guide rod 202 slidably mounted in the respective guide slot 14 of the gun body 10, the control valve 22 has two opposite sides each formed with a fixing recess 222, and the spraying gun further comprises two drive shafts 23 each rotatably mounted on the gun body 10 and each having a first end 232 extended through the respective pivot hole 13 of the gun body 10 and fixed in the respective fixing hole 201 of the control handle 20 to rotate with the control handle 20 and a second end 231 fixed in the respective fixing recess 222 of the control valve 22 for rotating the control valve 22.

The spraying gun further comprises an outer control tube 50 mounted on the gun body 10 and having a first end secured in a front portion of the chamber 12 of the gun body 10, a control shaft 30 mounted in the outer control tube 50 and having a first end located in the front portion of the chamber 12 of the gun body 10, a catch block 31 secured on a second end of the control shaft 30, an inner control tube 60 movably mounted in the outer control tube 50 and having an end portion movable relative to the catch block 31 to change a gap 1 defined between the catch block 31 and the end portion of the inner control tube 60, and a control ring 40 rotatably mounted on the outer control tube 50 and connected to the inner control tube 60 for moving the inner control tube 60 by rotation of the control ring 40. An outer ring 44 is secured on the control ring 40 for covering and rotating the control ring 40.

The end portion of the inner control tube 60 is formed with an annular guide portion 62 having a tapered inner wall facing the catch block 31. The gap 1 between the catch block 31 and the end portion of inner control tube 60 is connected to the chamber 12 of the gun body 10 through a space defined between the inner control tube 60 and the control shaft 30.

The inner control tube 60 has a peripheral wall formed with an oblique adjusting slot 61, the outer control tube 50 has a peripheral wall formed with an arc-shaped limit slot 51, and the spraying gun further comprises a push member 42 secured in the control ring 40 to rotate therewith, extended through the limit slot 51 of the outer control tube 50 and movably mounted in the adjusting slot 61 of the inner control tube 60 for pushing and moving the inner control tube 60 by rotation of the control ring 40. The adjusting slot 61 of the inner control tube 60 has a corrugated shape. The push member 42 is secured in the control ring 40 by a locking screw 41.

The peripheral wall of the outer control tube 50 is formed with a plurality of positioning holes 53 located opposite to the limit slot 51, and a spring-biased positioning ball 43 that is located opposite to the push member 42 is retractably mounted in the control ring 40 and detachably locked in either one of the positioning holes 53 of the outer control tube 50.

The spraying gun further comprises a drive ring 70 rotatably and movably mounted on the outer control tube 50, and a nozzle assembly 80 mounted on the drive ring 70 to move therewith so as to change a distance between the nozzle assembly 80 and the gap 1 defined between the catch block 31 and the end portion of the inner control tube 60.

The peripheral wall of the outer control tube 50 is formed with a plurality of elongated positioning grooves 54, and a spring-biased positioning ball 73 is retractably mounted in the drive ring 70 and detachably locked in either one of the positioning grooves 54 of the outer control tube 50.

The outer control tube 50 has a second end portion formed with an outer thread 52, and the drive ring 70 has an inner wall formed with an inner thread 71 rotatably screwed onto the outer thread 52 of the outer control tube 50.

The drive ring 70 has an outer wall formed with a mounting portion 72, and the nozzle assembly 80 includes a nozzle head 81 having a first end formed with a mounting hole 811 mounted on the mounting portion 72 of the drive ring 70 and a second end formed with a stepped receiving recess 812, a first mounting ring 82 mounted on the mounting portion 72 of the drive ring 70 and received in the receiving recess 812 of the nozzle head 81, a second mounting ring 84 mounted in the receiving recess 812 of the nozzle head 81 and engaged with the first mounting ring 82, and a rotation ring 83 rotatably mounted between the first mounting ring 82 and the second mounting ring 84 and having a periphery formed with a plurality of blades 832 that are movable with the drive ring 70 so as to change a distance between the blades 832 of the rotation ring 83 and the gap 1 defined between the catch block 31 and the end portion of the inner control tube 60.

The second mounting ring 84 has an inner wall formed with a stepped receiving recess 841 to receive the rotation ring 83. The first mounting ring 82 has an outer wall formed with an outer thread 821, and the receiving recess 841 of the second mounting ring 84 has a distal end formed with an inner thread 842 screwed onto the outer thread 821 of the first mounting ring 82. The rotation ring 83 has a side formed with a protruding slide track 831 slidably mounted between the first mounting ring 82 and the second mounting ring 84.

Figure 4:
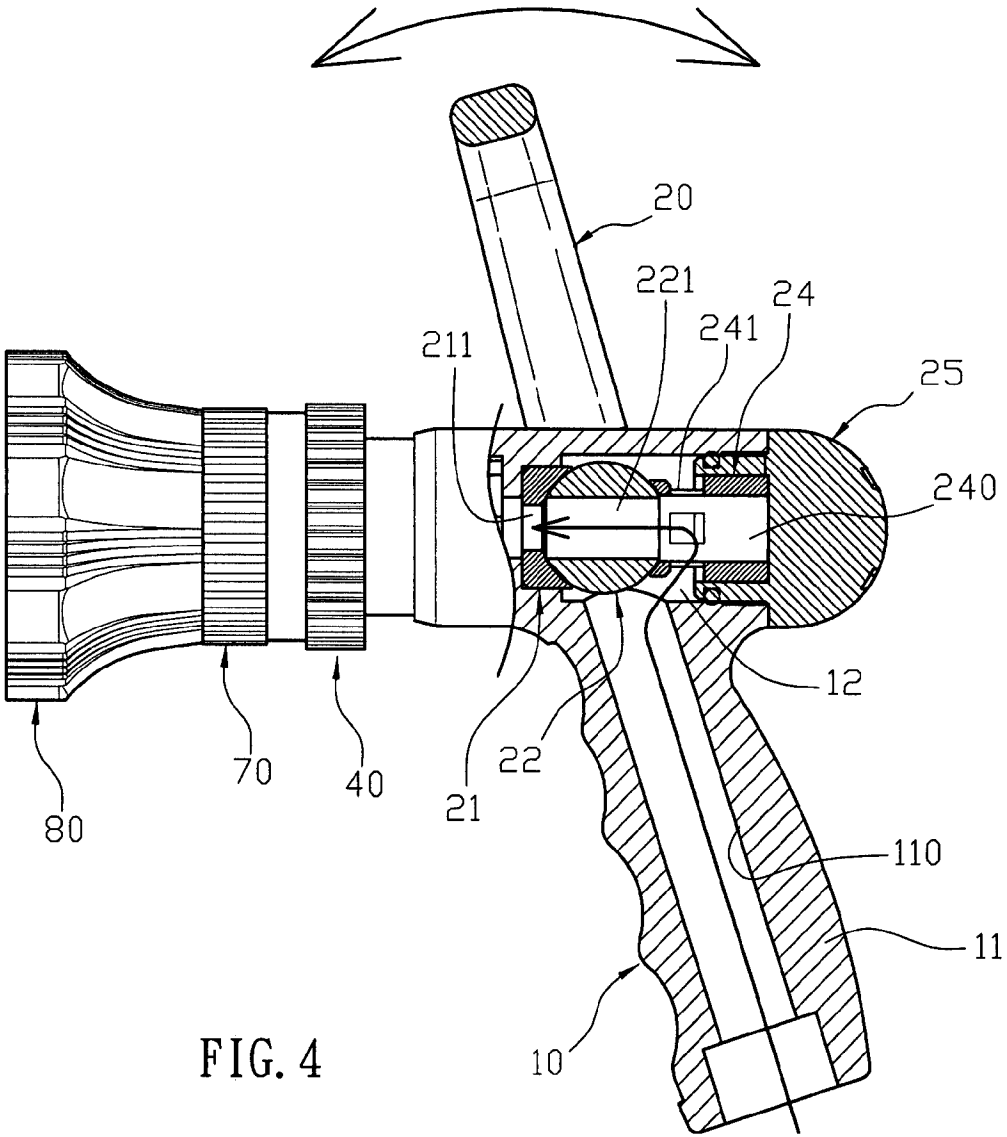
FIG. 4 is a partially side plan cross-sectional view of the spraying gun as shown in FIG. 1.
Figure 5:
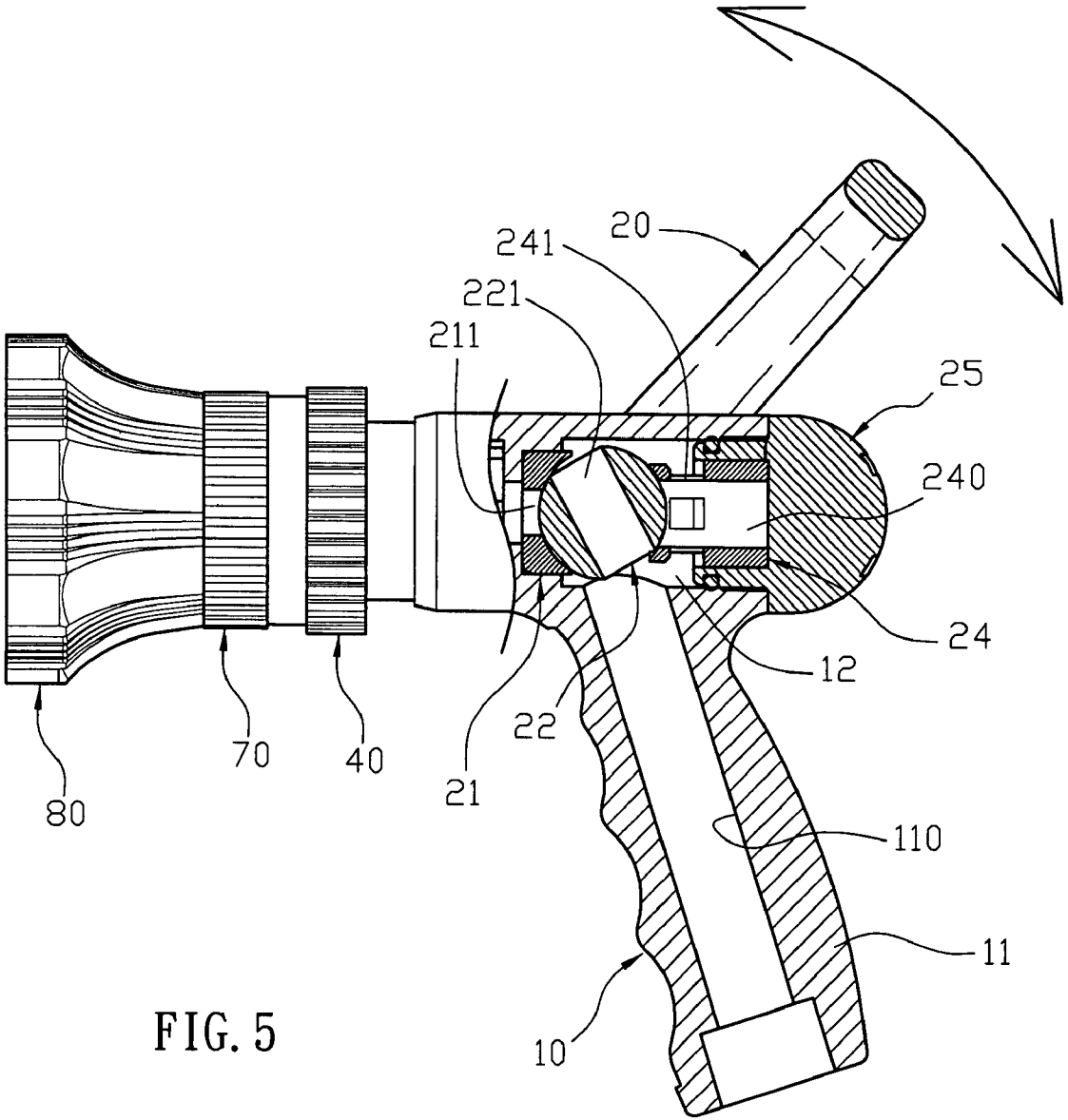
FIG. 5 is a schematic operational view of the spraying gun as shown in FIG. 4.

In operation, as shown in FIGS. 4 and 5, when the control handle 20 is pivoted on the gun body 10, each of the two drive shafts 23 is rotated by the control handle 20 to rotate the control valve 22. Thus, the control valve 22 is rotatable in the chamber 12 of the gun body 10 to move the control hole 221 so that the passage 240 of the connecting member 24 is partially connected to the control hole 221 of the control valve 22 and partially interrupted by the peripheral wall of the control valve 22, thereby changing the contact area between the peripheral wall of the control valve 22 and the passage 240 of the connecting member 24 so as to adjust the flow rate from the passage 240 of the connecting member 24 into the control hole 221 of the control valve 22.

In such a manner, the control handle 20 is pivoted on the gun body 10 to rotate the control valve 22 so as to open and close the water flow and to adjust the water flow rate of the spraying gun.

Figure 6:
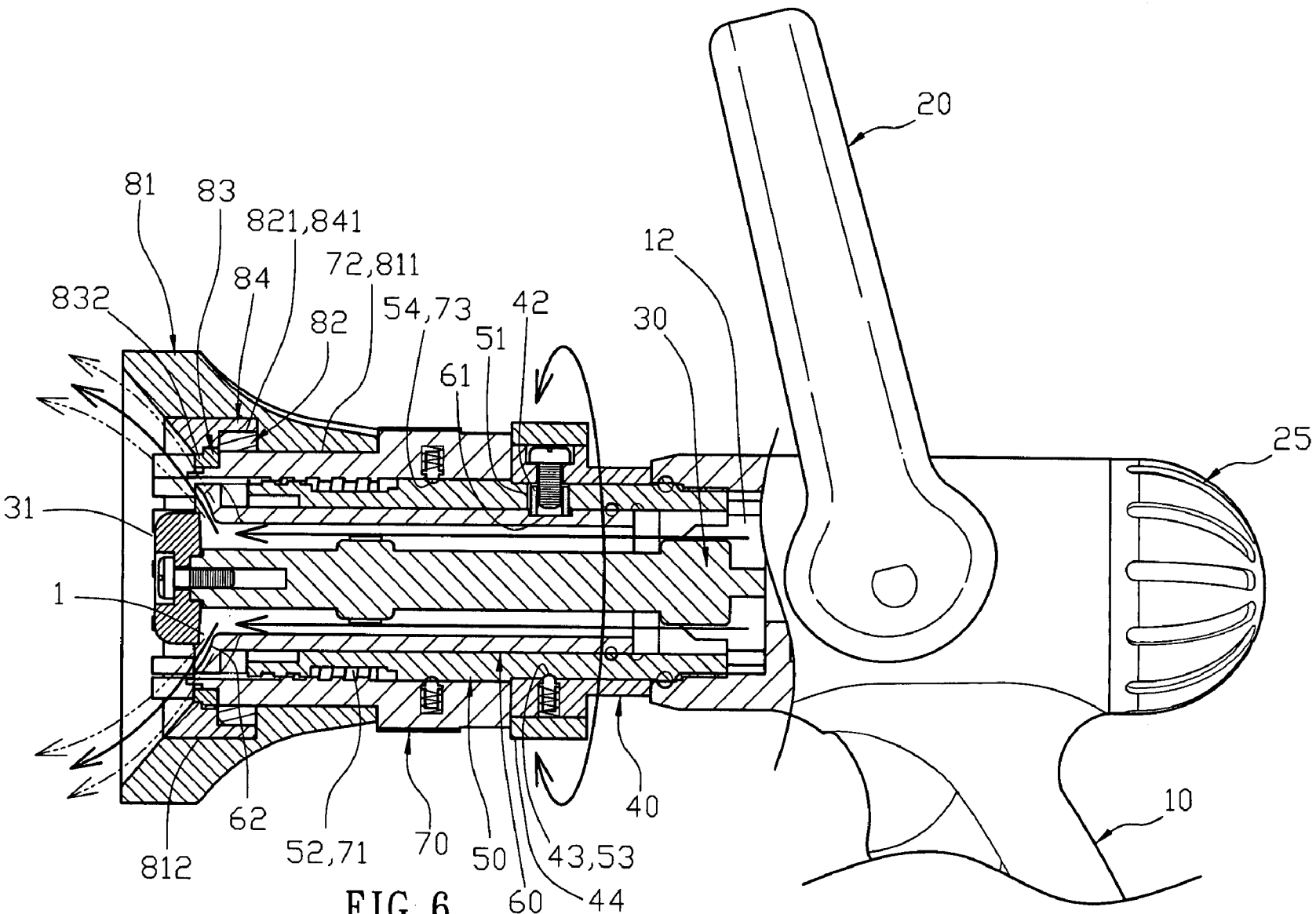
FIG. 6 is a partially side plan cross-sectional view of the spraying gun as shown in FIG. 1.

Alternatively, as shown in FIG. 6, when the control ring 40 is rotated by the outer ring 44, the push member 42 secured in the control ring 40 is movable in the limit slot 51 of the outer control tube 50 and movable in the oblique adjusting slot 61 of the inner control tube 60 for pushing the inner control tube 60 to move forward and backward to change the gap 1 defined between the catch block 31 and the end portion of the inner control tube 60, so as to adjust the diffusion angles and the strength of the water flow ejected outward from the gap 1 defined between the catch block 31 and the end portion of the inner control tube 60.

In such a manner, the control ring 40 is rotated to drive the push member 42 to push the inner control tube 60 to move to change the gap 1 defined between the catch block 31 and the end portion of the inner control tube 60, so as to adjust the diffusion angles and the strength of the water flow ejected outward from the gap.

Figure 7:
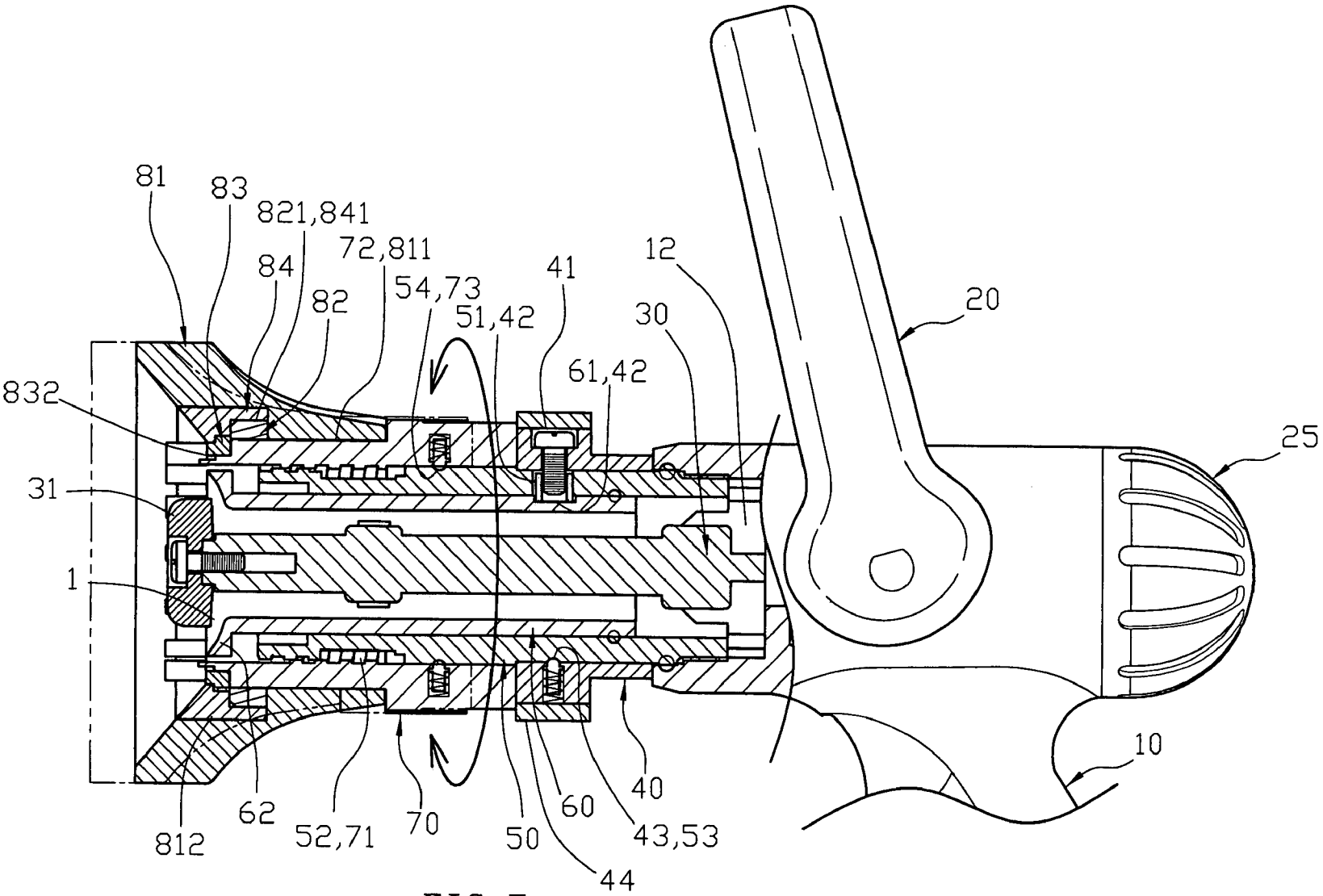
FIG. 7 is a schematic operational view of the spraying gun as shown in FIG. 6.
Figure 8:
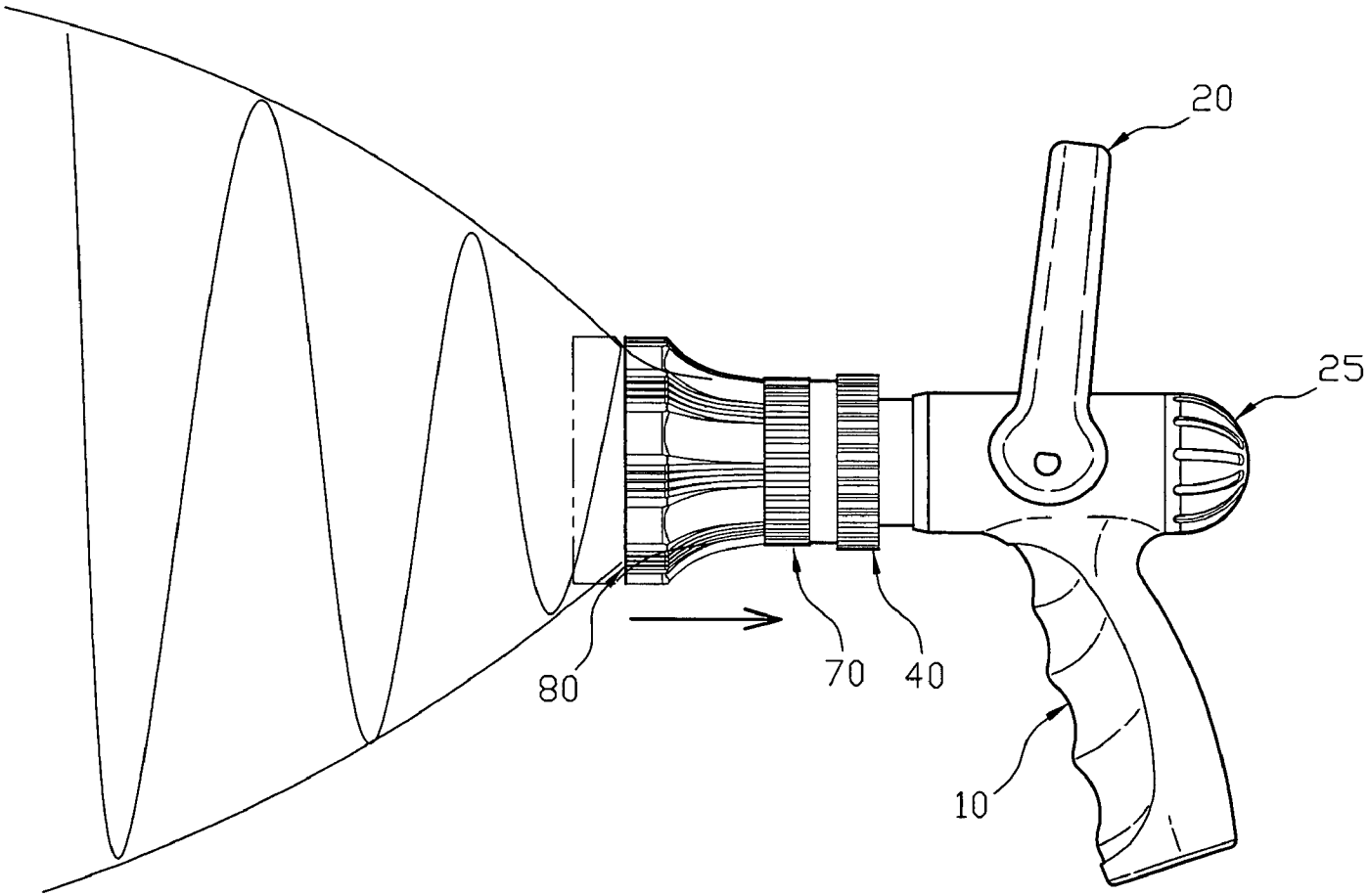
FIG. 8 is a side plan schematic operational view of the spraying gun as shown in FIG. 1.
Figure 9:
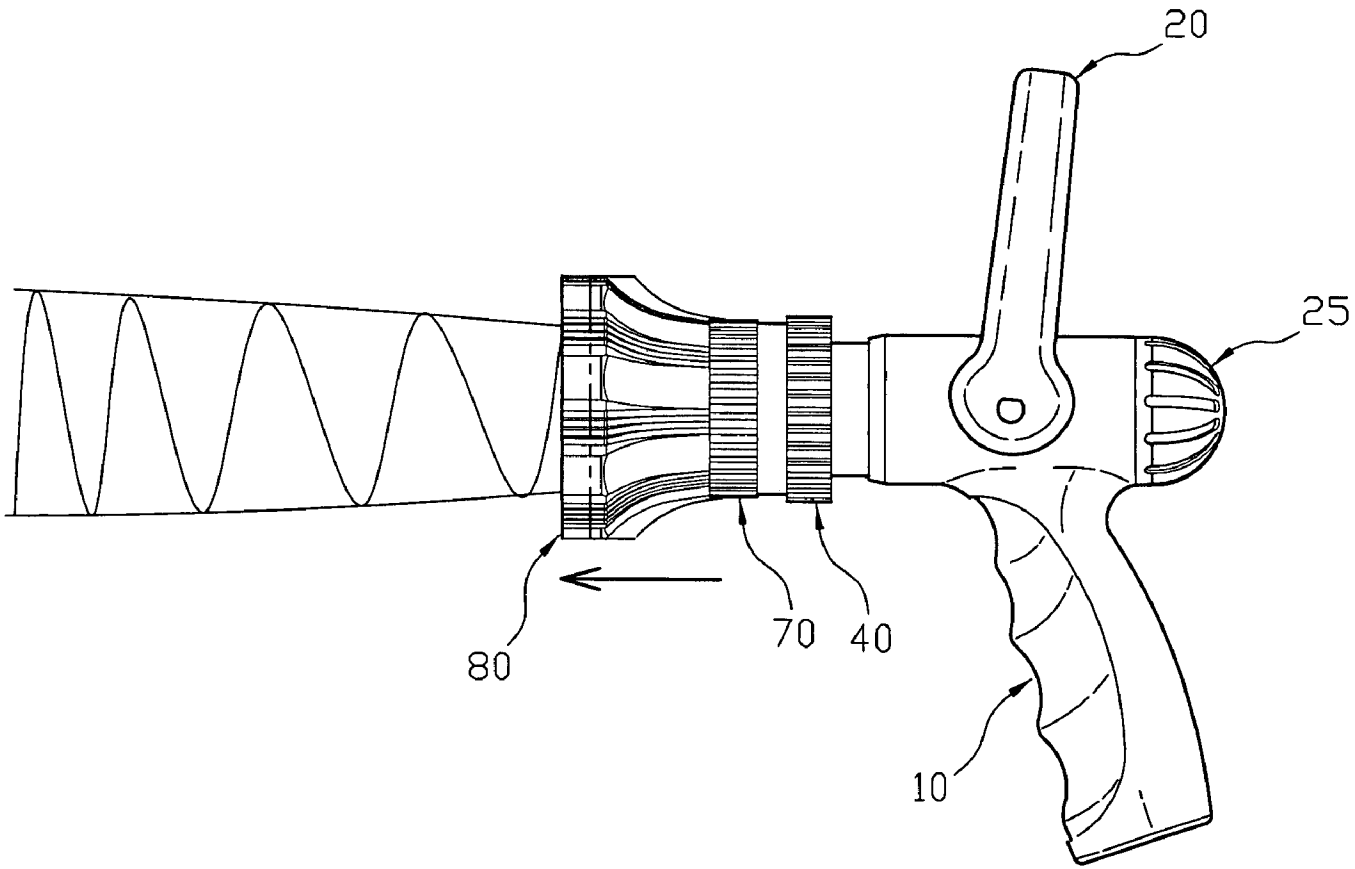
FIG. 9 is a schematic operational view of the spraying gun as shown in FIG. 8.

Alternatively, as shown in FIGS. 7–9, when the drive ring 70 is rotated, the inner thread 71 of the drive ring 70 is movable on the outer thread 52 of the outer control tube 50, so that the drive ring 70 is movable on the outer control tube 50 to move the nozzle assembly 80 to change the distance between the blades 832 of the rotation ring 83 and the gap 1 defined between the catch block 31 and the end portion of the inner control tube 60, so as to adjust the diffusion areas and the intensity of the water flow ejected outward from the gap 1 defined between the catch block 31 and the end portion of the inner control tube 60.

In such a manner, the drive ring 70 is rotated to move the nozzle assembly 80 to change the distance between the blades 832 of the rotation ring 83 and the gap 1 defined between the catch block 31 and the end portion of the inner control tube 60, so as to adjust the diffusion areas and the intensity of the water flow ejected outward from the gap.

Accordingly, the control handle 20 is pivoted on the gun body 10 to rotate the control valve 22 so as to open and close the water flow and to adjust the water flow rate of the spraying gun. In addition, the control ring 40 is rotated to drive the push member 42 to push the inner control tube 60 to move to change the gap 1 defined between the catch block 31 and the end portion of the inner control tube 60, so as to adjust the diffusion angles and the strength of the water flow ejected outward from the gap. Further, the drive ring 70 is rotated to move the nozzle assembly 80 to change the distance between the blades 832 of the rotation ring 83 and the gap 1 defined between the catch block 31 and the end portion of the inner control tube 60, so as to adjust the diffusion areas and the intensity of the water flow ejected outward from the gap. Further, the spraying gun has a three-stage control effect to provide different water output functions so as to fit a user's practical requirements, thereby enhancing the versatility of the spraying gun.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spraying gun, comprising:

a gun body having an inside formed with a chamber;

a handle mounted on the gun body and having an inside formed with a water inlet channel connected to the chamber of the gun body;

a sealing gasket mounted in the chamber of the gun body and having an inside formed with a through hole;

a connecting member mounted in the chamber of the gun body and having an inside formed with a passage and a peripheral wall formed with a plurality of conducting holes each connected to the passage and the water inlet channel of the handle; and a control valve rotatably mounted in the chamber of the gun body between the sealing gasket and the connecting member and having an inside formed with a control hole connected to the passage of the connecting member and the through hole of the sealing gasket.

2. The spraying gun in accordance with claim 1, wherein the control valve is rotatable in the chamber of the gun body to move the control hole so that the passage of the connecting member is partially connected to the control hole of the control valve and partially interrupted by a peripheral wall of the control valve, thereby changing a contact area between the peripheral wall of the control valve and the passage of the connecting member so as to adjust a flow rate from the passage of the connecting member into the control hole of the control valve.

3. The spraying gun in accordance with claim 1, further comprising a substantially U-shaped control handle pivotally mounted on the gun body and connected to the control valve to rotate the control valve.

4. The spraying gun in accordance with claim 3, wherein the gun body has two opposite sides each formed with a pivot hole and an arc-shaped guide slot, the control handle has two distal ends each formed with a fixing hole aligning with the respective pivot hole of the gun body and a guide rod slidably mounted in the respective guide slot of the gun body, the control valve has two opposite sides each formed with a fixing recess, and the spraying gun further comprises two drive shafts each rotatably mounted on the gun body and each having a first end extended through the respective pivot hole of the gun body and fixed in the respective fixing hole of the control handle to rotate with the control handle and a second end fixed in the respective fixing recess of the control valve for rotating the control valve.

5. The spraying gun in accordance with claim 1, further comprising an end cap mounted on the gun body and rested on the connecting member to cover the connecting member in the chamber of the gun body.

6. A spraying gun, comprising:

a gun body having an inside formed with a chamber;

an outer control tube mounted on the gun body and having a first end secured in the chamber of the gun body;

a control shaft mounted in the outer control tube and having a first end located in the front portion of the chamber of the gun body;

a catch block secured on a second end of the control shaft;

an inner control tube movably mounted in the outer control tube and having an end portion movable relative to the catch block to change a gap defined between the catch block and the end portion of the inner control tube; and a control ring rotatably mounted on the outer control tube and connected to the inner control tube for moving the inner control tube by rotation of the control ring.

7. The spraying gun in accordance with claim 6, wherein the inner control tube has a peripheral wall formed with an oblique adjusting slot, the outer control tube has a peripheral wall formed with an arc-shaped limit slot, and the spraying gun further comprises a push member secured in the control ring to rotate therewith, extended through the limit slot of the outer control tube and movably mounted in the adjusting slot of the inner control tube for pushing and moving the inner control tube by rotation of the control ring.

8. The spraying gun in accordance with claim 6, further comprising a drive ring rotatably and movably mounted on the outer control tube, and a nozzle assembly mounted on the drive ring to move therewith so as to change a distance between the nozzle assembly and the gap defined between the catch block and the end portion of the inner control tube.

9. The spraying gun in accordance with claim 8, wherein the peripheral wall of the outer control tube is formed with a plurality of elongated positioning grooves, and the spraying gun further comprises a spring-biased positioning ball retractably mounted in the drive ring and detachably locked in either one of the positioning grooves of the outer control tube.

10. The spraying gun in accordance with claim 8, wherein the outer control tube has a second end portion formed with an outer thread, and the drive ring has an inner wall formed with an inner thread rotatably screwed onto the outer thread of the outer control tube.

11. The spraying gun in accordance with claim 8, wherein the drive ring has an outer wall formed with a mounting portion, and the nozzle assembly includes a nozzle head having a first end formed with a mounting hole mounted on the mounting portion of the drive ring and a second end formed with a stepped receiving recess, a first mounting ring mounted on the mounting portion of the drive ring and received in the receiving recess of the nozzle head, a second mounting ring mounted in the receiving recess of the nozzle head and engaged with the first mounting ring, and a rotation ring rotatably mounted between the first mounting ring and the second mounting ring and having a periphery formed with a plurality of blades that are movable with the drive ring so as to change a distance between the blades of the rotation ring and the gap defined between the catch block and the end portion of the inner control tube.

12. The spraying gun in accordance with claim 11, wherein the second mounting ring has an inner wall formed with a stepped receiving recess to receive the rotation ring.

13. The spraying gun in accordance with claim 12, wherein the first mounting ring has an outer wall formed with an outer thread, and the receiving recess of the second mounting ring has a distal end formed with an inner thread screwed onto the outer thread of the first mounting ring.

14. The spraying gun in accordance with claim 11, wherein the rotation ring has a side formed with a protruding slide track slidably mounted between the first mounting ring and the second mounting ring.

15. The spraying gun in accordance with claim 6, further comprising an outer ring secured on the control ring for covering and rotating the control ring.

16. The spraying gun in accordance with claim 6, wherein the end portion of the inner control tube is formed with an annular guide portion having a tapered inner wall facing the catch block.

17. The spraying gun in accordance with claim 6, wherein the gap between the catch block and the end portion of inner control tube is connected to the chamber of the gun body through a space defined between the inner control tube and the control shaft.

18. The spraying gun in accordance with claim 7, wherein the adjusting slot of the inner control tube has a corrugated shape.

* * * * *